United States Patent [19]

Kranz

[11] 4,233,970

[45] Nov. 18, 1980

[54] EMERGENCY ESCAPE BREATHING APPARATUS

[75] Inventor: Max L. Kranz, Brea, Calif.

[73] Assignee: Robertshaw Controls Company, Richmond, Va.

[21] Appl. No.: 961,291

[22] Filed: Nov. 16, 1978

Related U.S. Application Data

[63] Continuation-in-part of Ser. No. 883,362, Mar. 6, 1978.

[51] Int. Cl.[3] ..... A62B 7/02

[52] U.S. Cl. ..... 128/201.28; 128/205.24

[58] Field of Search ..... 128/142 R, 142 G, 142.2, 128/142.3, 142.5, 142.7, 145 R, 145.8, 147, 203, 201.28, 205.24; 2/205, 202, 7, 2; 137/505.41, 458, 464

[56] References Cited

U.S. PATENT DOCUMENTS

| | | | |
|---|---|---|---|
| 2,262,522 | 11/1941 | Yant et al. | 128/200.27 |
| 2,296,338 | 9/1942 | Dakin | 128/201.15 |
| 3,043,302 | 7/1962 | Spears et al. | 128/205.24 |
| 3,250,292 | 5/1966 | Mollick | 137/505.41 |
| 3,562,813 | 2/1971 | Origer | 128/201.23 |
| 3,618,689 | 11/1971 | German | 137/464 X |
| 3,762,407 | 10/1973 | Shonerd | 128/201.23 |
| 3,911,914 | 10/1975 | Johansson | 128/201.23 |
| 3,976,063 | 8/1976 | Henneman et al. | 128/201.25 |
| 3,976,067 | 8/1976 | Amlong | 128/204.21 |

*Primary Examiner*—Henry J. Recla

*Attorney, Agent, or Firm*—Fulwider, Patton, Rieber, Lee & Utecht

[57] ABSTRACT

There is disclosed an emergency escape breathing apparatus comprising a hood to be placed over a person's head and a pressured bottle supply of air or oxygen enriched air. The hood is formed of thin film, clear plastics having an elastic neck band to permit the hood to be pulled over the wearer's head, and yieldably seals about the wearer's neck, functioning as an exhalation valve, maintaining adequate pressure to keep the hood inflated. The device is provided with a valve on the air supply bottle which has a reseatable valve member and two stages of flow control; the first stage being pressure control, providing a variable flow area which increases with declining pressure in the air supply bottle, and the second stage being flow control having a fixed diameter orifice. The bottle contains air enriched with oxygen below any hazardous oxygen content yet sufficient to provide at least 5 minutes sustained respiration of the user.

4 Claims, 7 Drawing Figures

FIGURE 1
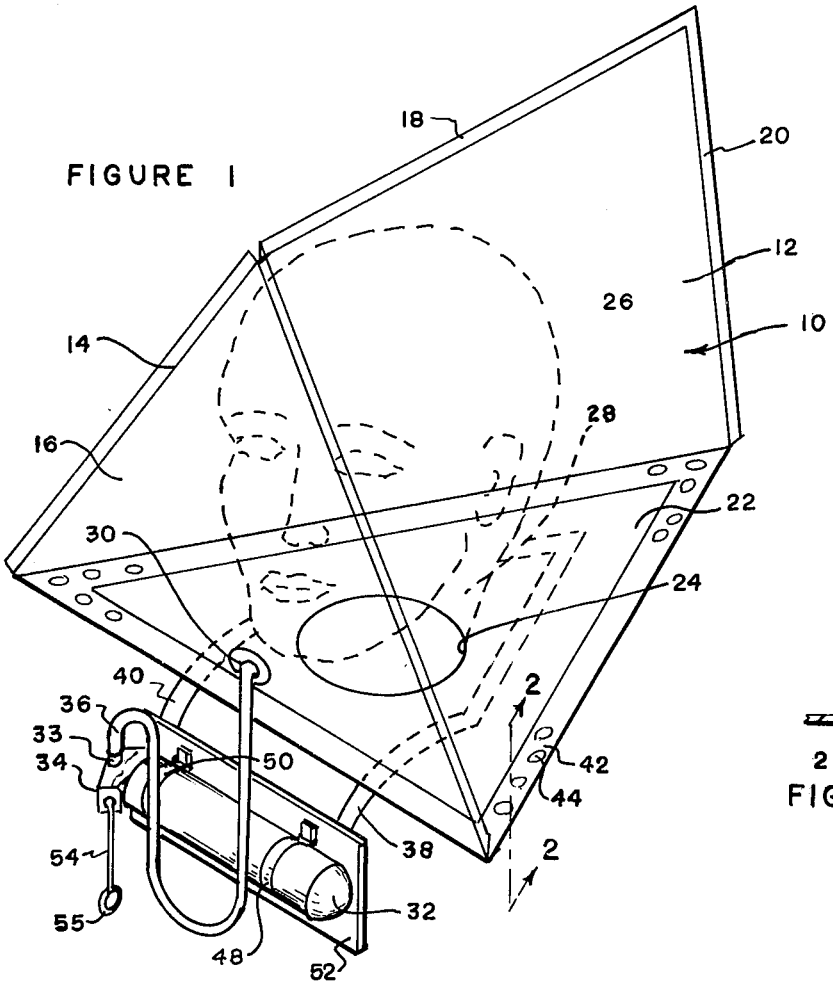
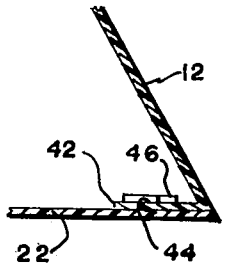
FIGURE 2
FIGURE 3
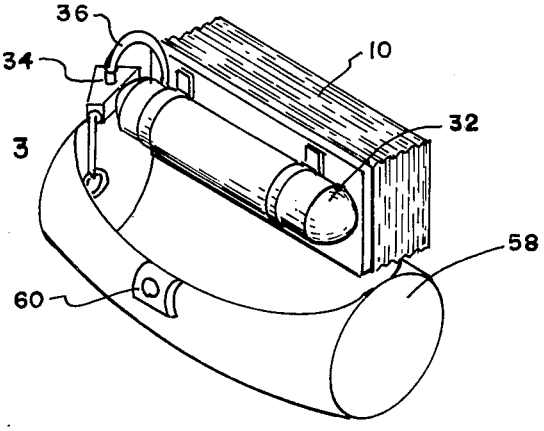

EMERGENCY ESCAPE BREATHING APPARATUS

RELATIONSHIP TO OTHER APPLICATIONS

This application is a continuation-in-part of my prior application, Ser. No. 883,362, filed on Mar. 6, 1978.

BACKGROUND OF THE INVENTION

1. Field of the Invention

This invention relates to an emergency breathing apparatus particularly suited for providing a short term air supply to a wearer in a hostile environment such as a smoke-filled or burning building.

2. Brief Statement of the Prior Art

Emergency escape hoods which have been designed for use by industry and municipal fire fighters comprise a transparent hood that is pulled over the wearer's head and a pressured supply of air or oxygen which is released to the hood through a sealing diaphragm which is ruptured by a lever actuated by the wearer. The devices which have been developed to date are relatively bulky, being formed of thick film plastics with an elastic band to seal the hood about the wearer's neck and have required a separate exhalation valve. Additionally, the devices have employed valves with rupture diaphragms rather than reseatable valves and thereby are more costly to recycle for reuse.

BRIEF DESCRIPTION OF THE INVENTION

This invention comprises an emergency escape breathing device which has a head hood formed of thin film plastics with an elastic neck closure. The closure can be a thin film elastomer hood base having a central aperture that permits placement of the hood over the wearer's head and that sealingly engages the wearer's neck. The elastomer film yieldably engages the wearer's neck to permit it to function similar to a flapper valve, eliminating the necessity for use of a separate exhalation valve. In another embodiment, the hood has an elastic neck band which serves the same functions. The preferred hood has an anti-fogging construction which includes a plurality of layers of the plastic film over the face area and an inner pocket, or flap, air deflector that directs the incoming air across the face of the hood, thereby preventing moisture condensation on this area.

The emergency escape breathing device also employs an air supply valve having a reseating valve member and two flow control stages. The first flow control stage comprises a ball resiliently seated against a hard metal seat and lifted therefrom by a pin which seats against the face of the reseating valve member. The latter is biased closed by a spring which biases the pin to constantly vary the flow area between the ball and hard metal seat in response to the air supply pressure. The second control stage controls the rate of flow and comprises a fixed diameter orifice passageway discharging into the tubing which communicates with the hood of the device.

The preferred air supply is a cylinder of oxygen-enriched air having an oxygen content no greater than about 28 volume percent, which is below any potentially hazardous level. This oxygen enrichment is sufficient to maintain an oxygen content in the hood of at least about 16 volume percent for five minutes from a supply bottle of an acceptable size and strength.

BRIEF DESCRIPTION OF THE DRAWINGS

The invention will be described with reference to the figures, of which:

FIG. 1 illustrates the hood of the invention as deployed over a person's head and in the inflated condition;

FIG. 2 is a view along lines 2—2;

FIG. 3 is a view of the hood in its folded, compact position for storage;

DESCRIPTION OF PREFERRED EMBODIMENTS

Figure 4:
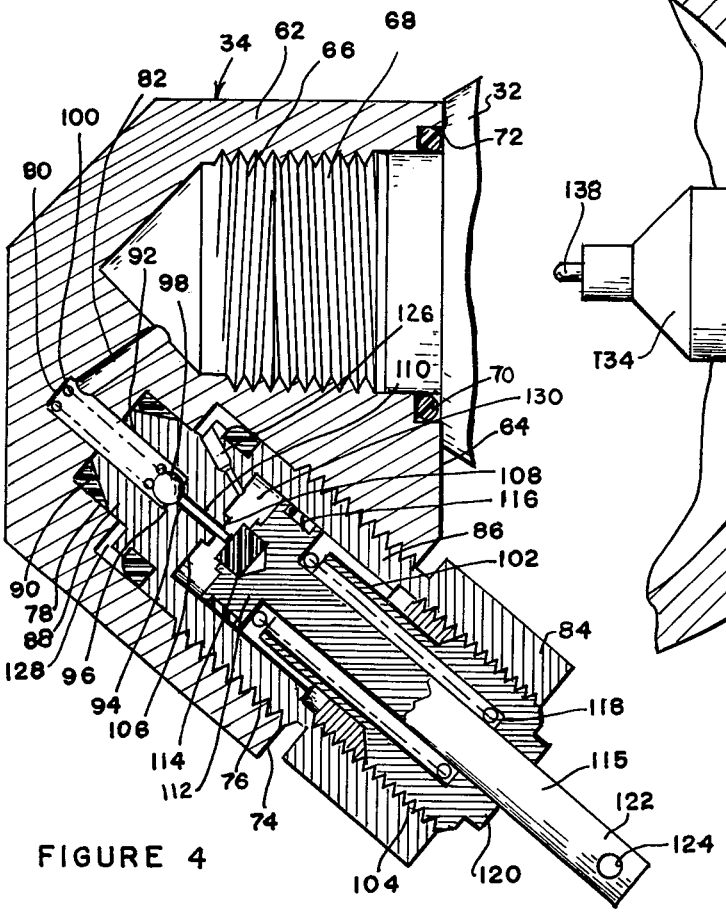
FIG. 4 is a sectional view of the gas control valve employed in the invention.

The invention is illustrated in FIG. 1 as comprising a hood 10 in the form of a sealed tent with vertical walls 12, 14 and 16 which are joined at their edges in seals such as 18 and 20 and which are secured, along with bottom edges to a thin elastomer film 22. The latter has a central opening 24 of sufficient diameter to receive the wearer's head 26 in a stretched state and to yieldably seal, when released, about the person's neck 28. The hood 10 has a single aperture 30 which connects to a breathable-atmosphere source, bottle 32, which contains a pressured supply of a breathable gas, typically an elemental oxygen containing gas such as oxygen, air or oxygen-enriched air.

The cylinder 32 is connected through a gas control valve 34 to a flexible tubing 36 which communicates with aperture 30. The bottle 32 is carried by straps 38 and 40 which extend to the elastomer film 22 and which are secured thereto. These straps extend about the central aperture 24 so the straps provide support for container 32.

The hood is formed of suitable thin film plastics. The tent of upright walls 12, 14 and 16 is formed of thin plastics of thicknesses less than about 3 mils which are preferably Kapton, a polyimide plastic having high tensile strength and a high useful temperature; the material resists charring at temperatures up to about 1472° F. Another useful plastic for this purpose is Mylar, a trade designation of DuPont deNemours for a polyester film of high tensile strength.

The bottom wall 22 is of a suitable elastomer, preferably synthetic or natural rubber latex which has a high resistance and sufficient elasticity to permit stretching to fit over the wearer's head. The elastomer film also serves as an exhalation valve since it yieldably seals about the wearer's neck after the hood is in place. The elastomer film thus maintains an appropriate internal pressure to keep the hood in its inflated and expanded position shown in FIG. 1 while permitting comfortable breathing for the wearer.

The elastomer film 22 is sealed to the bottom edges of the upright walls 12, 14 and 16. To this end, the bottom edges of the upright walls are folded inwardly at 42 and, preferably, bear a plurality of perforations 44. During assembly, the elastomer film is heat sealed to the bottom edges 42. This preferred seal is illustrated in FIG. 2 where the elastomer film 22 extrudes to form plugs 46 which extend through the apertures 44.

The bottle 32 is carried in the assembly by a pair of strap retainers 48 and 50 which are secured to a plate 52 that is attached to the ends of straps 38 and 40. The gas supply valve 34 has a flow control valve member which is secured to lanyard 54 having a pull ring 56 for actuation by the wearer.

The entire assembly is very compact and can be folded and stored readily. FIG. 3 illustrates the assembly in its folded condition with the hood 10 collapsed and folded, accordion fashion, against plate 52, thereby permitting the entire assembly to be placed within a small valise or container 58 having a snap fastener 60 or the like.

Referring now to FIG. 4, the gas supply valve 34 will be described. As illustrated, the valve 34 comprises a valve housing 62 formed of a metal block having the valve passageways machined therein. The block 62 has a face 64 which bears an internally threaded aperture 66 which receives the threaded neck 68 of a pressure container such as the bottle 32 previously described. This assembly is sealed by O-ring 70 within a peripheral groove 72 about aperture 66.

Block 62 has an oblique face 74 which bears an internally threaded bore 76 that extends into but not through block 62. The bore 76 is counterbored at 78 and 80 at progressively decreasing diameters and a communicating passageway 82 is bored to extend from bore 66.

A valve insert member 84 is threadably received in bore 76 with its threaded shank 86 engaged by the threaded bore 76. The inboard end of shank 86 has a reduced diameter portion 88 which is received within counterbore 78. A resilient sealing gasket 90 is captured within this counterbore 78. The forward end of the insert member 84 is bored with a longitudinal passageway 92 and counterbored at 94 with a smaller diameter passageway, thereby forming a hard metal shoulder or seat 96. A ball 98 is placed in the bore 92 and is resiliently biased against the hard metal seat 96 by a helical coil spring 100 which is coaxially mounted within bore 92.

The opposite end of the insert number 84 has a larger diameter bore 102 which bears internal threads 104 and which communicates with the small diameter bore 94. The inboard end of this bore is milled at 106 to provide an annular seat 108 about the small diameter bore 94.

A metal pin 110 is slidably received within bore 94 and serves as a lift pin for ball 98. This pin is biased against the inboard end of the valve member piston 112 which has a central plug 114 of a soft plastic material such as polyurethane and the like for sealably engaging against the annular seat 108. Piston 112 has a peripheral groove which receives a sealing or packing means 116.

The valve closure member 115 is resiliently biased into a sealing position against the annular seat 108 by a resilient means in the form of a helical coil compression spring 118 which is captured between the inboard face of piston 112 and spring retainer 120 which is threadably received by threaded bore 104. The rod 122 of the piston actuator is bored at 124 for attachment of a lanyard and the like.

The inboard end of the insert member 84 bears a small diameter orifice passageway 126 which discharges into a chamber 128 in the valve housing block 62. This chamber 128 communicates with the discharge from the valve housing, conduit 33 shown in FIG. 1.

The valve structure as thus described comprises a start valve having a reseatable, resiliently biased valve closure member defined by piston 112 having a soft and sealing seat member 114 that engages the annular seat 108. The valve structure also has a pressure control means which comprises the ball 98 that engages against the hard metal seat 96. This ball member is biased closed by the internal pressure of the cylinder and the resilient spring 100. A sealing seat is not achieved because of the hard metal seat 96. As the supply pressure of the gas decreases, the ball member is lifted from seat 96 by pin 110 that is resiliently biased through valve member 115 and the resilient coil spring 118. This valve member thereby serves as a pressure regulator to maintain a substantially constant pressure within the chamber 130. The valve member also has a flow control means in the form of a fixed diameter orifice passageway 126 which communicates from chamber 130 to the outer chamber 128 which is an open communication through conduit 33 and flexible hose 36 to the hood of the invention. The gas supply valve 34 thus functions as a constant flow regulator to provide a predetermined and substantially constant gas flow into the hood during use of the device.

Figure 5:
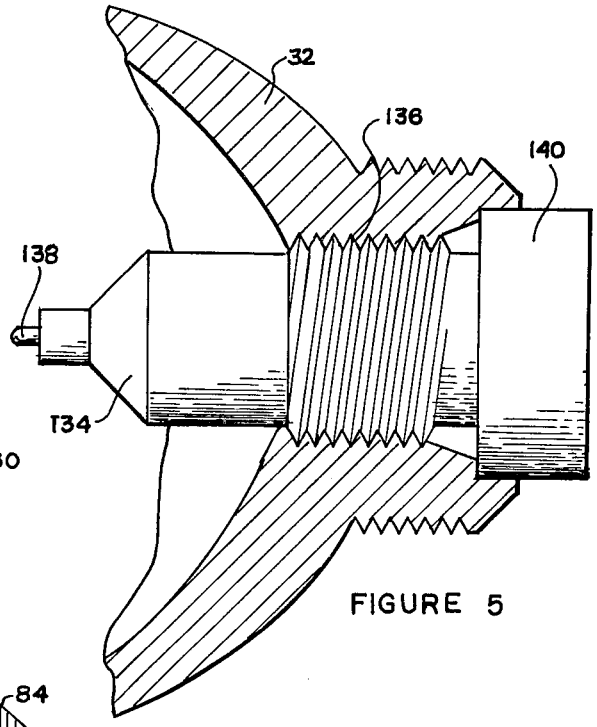
FIG. 5 is a view of a suitable pressure indicator useful in the invention.

The gas supply cylinder 32 can be provided with a suitable pressure indicator means. FIG. 5 illustrates the use of a suitable pressure indicator 134 which is threadably received in the internally threaded neck 136 at the opposite end of cylinder 32 from that received in the valve block 62. This pressure indicator is a conventional design and and comprises a pressure responsive helix Bourdon tube 138 that extends to a dial gauge 140 to reflect the internal pressure of cylinder 32.

Figure 6:
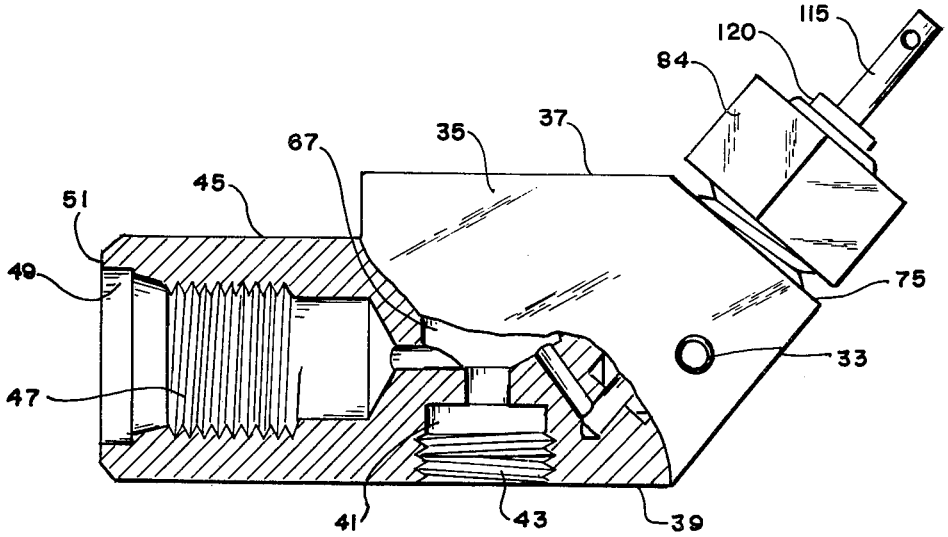
FIG. 6 is a view of an alternative embodiment of the gas flow control valve used in the invention.

Referring now to FIG. 6, another embodiment of the gas supply valve is illustrated. As there illustrated, the gas supply valve is contained within a machined block 35 which has a first face 37 that bears an internally threaded bore 67 which, as bore 66 described in FIG. 4, receives the neck of a pressured gas bottle such as 32. This block 35 also has an oblique face 75 which is machined similarly to that described in FIG. 4 to receive the valve insert member 84 which secures the same valve elements as described with regard to FIG. 4, including the rod 115 of the valve member and the spring retainer 120, all previously described.

The valve structure of FIG. 6 differs from that of FIG. 4 in that the face 39 has an internally threaded bore 41 which receives a flangible disc or rupture element 43. This element is of conventional, burst disc type construction and is adapted to rupture at the maximum safe operating pressure of the device, e.g., at about 6500–8000 psi.

The valve block 35 of the FIG. 6 embodiment also has an off-set portion 45 which has an internally threaded bore 47. A peripheral groove 49 is formed in the face 51 of this member. This threaded bore 47 is similar to the threaded neck 136 of the gas supply container 32 so that it can receive the pressure indicator assembly 134 with the dial indicator 140 described and illustrated in FIG. 5. In this manner, the block 35 contains all the functioning elements of the gas supply container, i.e., the gas supply valve mechanism, a rupture or burst disc member to protect against over-inflation, and an available pressure indicator.

Figure 7:
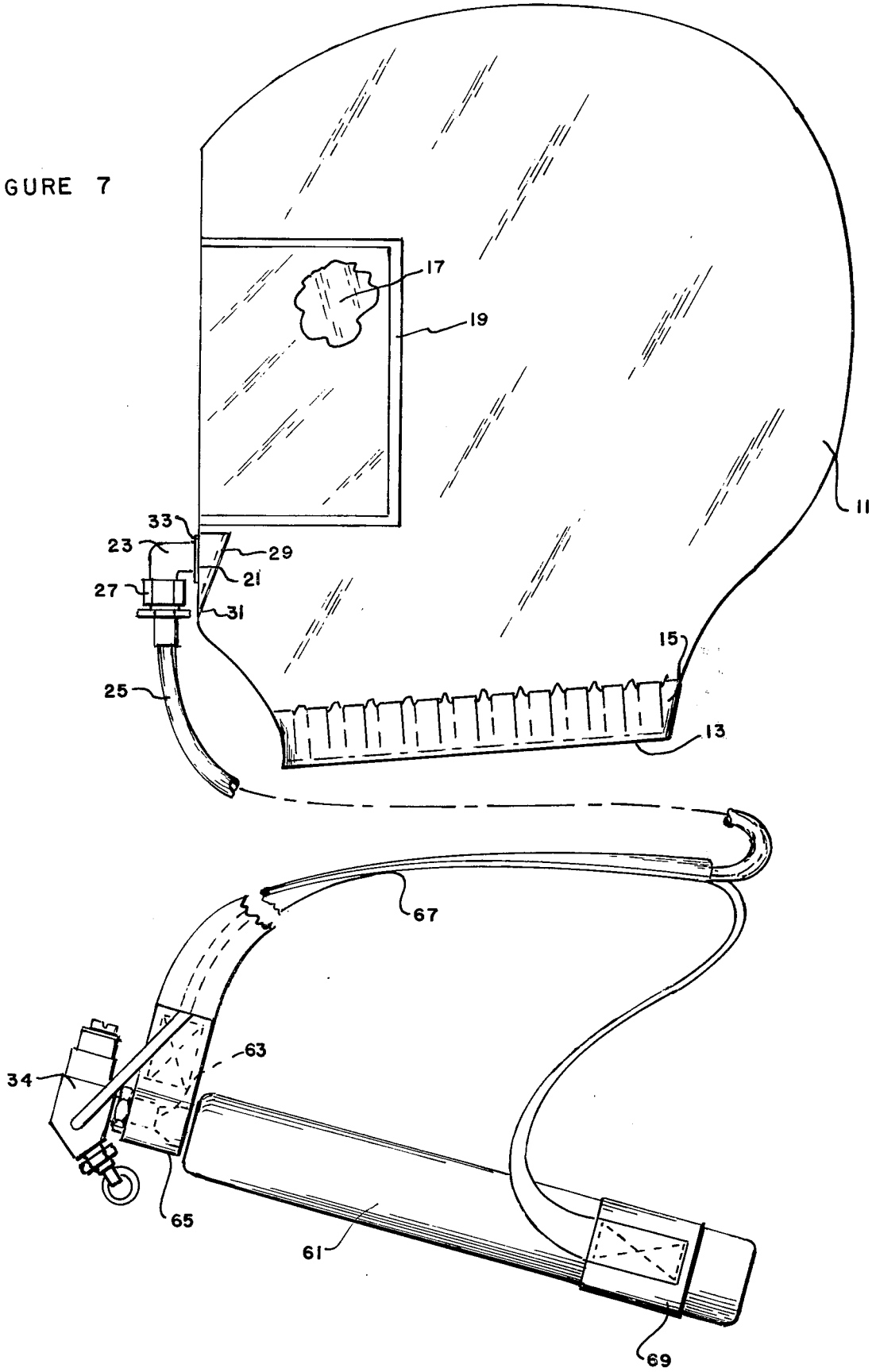
FIG. 7 is a view of a preferred emergency breathing apparatus.

FIG. 7 illustrates the presently preferred embodiment of the emergency breathing apparatus. In this device, the hood 11 is formed of a thin film, clear plastic such as Capton, Milar, previously mentioned, polyvinyl chloride, and the like. The hood is generally ovaloid in shape, matching the typical contour of the wearer's head and has an open bottom 13 which is encircled by an elastomeric band 15 such as an elastic fabric banding. The elastic band 15 will stretch to receive the wearer's head through the opening 13 and will yieldably seal, when released, about the user's neck.

A double layer of the plastic film, comprising the outer hood layer and an inner layer 17 of the plastic is disposed across the face portion of the hood. The two layers are bonded together at the perimeter 19 of the inner layer 17. The hood 11 has a single aperture 21 which receives fitting 23 that is attached to the air supply hose 25. To this end, fitting 23 has an externally threaded neck that receives the internally threaded nut 27 distally carried on hose 25. The hood 11 has an internal flap 29 which overlies the aperture 21, forming an internal pocket which is sealed along its bottom edge 31 and the side edges to the inside wall of hood 11. The upper edge of the flap 29 is open permitting the flap to distend into the illustrated position whereby air can be admitted into the hood and, when so admitted, directed along the arrowhead line to flow across the face area of the hood. The provision of the double layer 17 of the clear plastic across the face portion of the hood and the deflection of the incoming air across this area insures that condensation of moisture does not occur and fogging of the hood in the field of vision of the user is effectively prevented.

Air hose 25 is connected to the gas control valve 34 that is carried on air supply bottle 61. The gas control valve is essentially the same as that described with regard to FIGS. 4–6. The air supply bottle 61 is preferably formed of aluminum or spun filament plastic and has an internal volume of about 29 cubic inches with a working or safe internal pressure of 1800 psig. The neck 63 of the bottle is encircled by strap 65 which has a looped portion 67 of sufficient length for receiving the shoulder of the wearer and which extends at its opposite end to an attachment with a fabric band 69 that encircles the opposite end of the air supply bottle 61.

The entire device can be designed to provide a constant flow of a breathable atmosphere over a predetermined time period, from about 3 to about 7 minutes, preferably about 5 minutes. The gas supply source shown in FIG. 1 comprises a nine cubic inch capacity steel container adapted for about 5000 psig internal pressure and this will supply adequate air to maintain a breathable atmosphere for a wearer under normal or extended exertion for a 5 minute period. The preferred gas supply source, shown in FIG. 7, is a lower pressure rated aluminum or spun filament plastic container. This container has a working pressure of 1800 psig and can have a volume of about 20 to 30 cubic inches to provide a supply of breathable oxygen for the same predetermined time.

The device functions by maintaining a breathable atmosphere about the wearer's head. A sufficient supply of air is available from the container to permit the wearer, when re-breathing the air contained within the hood, to maintain a level of at least about 16–17% oxygen within the hood over a period of five minutes. As the air is introduced into the hood, the exhalation valve (elastomer film 22 or neck band 15) provides a constant exhausting of the air from the hood thereby maintaining a constant, slightly superatmospheric pressure within the hood. Typically, this hood is maintained at a pressure of from 0.018 to about 0.036 psi above the surrounding atmosphere. The gas supply valve is designed to provide a flow rate of about 10 liters per minute which is sufficient to equal the consumption of oxygen at a moderate exertion level such as climbing stairs, about 1.6 liters per minute.

The gas supply container has a suitable source of a breathable atmosphere. For safety purposes, this can comprise air or oxygen-enriched air having an elemental oxygen content from 26 to about 32 volume percent, preferably about 28 volume percent, thereby avoiding any levels of oxygen which could readily ignite combustible materials. Alternatively, in some applications, it may be desirable to extend the usable period of the device by providing a breathable atmosphere containing higher elemental oxygen contents. Thus the invention contemplates the use of a pure oxygen or oxygen contents within the container 32 at any level from 20.9 to 100%.

The invention has been described with reference to the illustrated and presently preferred embodiments. It is not intended that the invention be unduly limited by this disclosure of the presently preferred embodiments. Instead, it is intended that the invention be defined by the means, and their obvious equivalents, set forth in the following claims:

What is claimed is:

1. Breathing apparatus comprising:

a protective hood for fitting about the head of a wearer and for containing an atmosphere of breathing gas, the base of said hood including an elastomeric neck closure adapted to admit the head of the wearer and yieldably seal in a stretched state against the neck of the wearer whereby said neck closure serves as an exhalation valve;

a supply bottle for providing breathing gas for said hood, said supply bottle having a threaded neck; and flow regulating gas supply valve means including:

(a) a valve body having an internally threaded first bore for engagement with said threaded neck of said supply bottle to receive breathing gas therefrom, said valve body further having means, including an elongated internally threaded receptacle having an outlet port adjacent its inner extremity, for conveying breathing gas to said hood;

(b) a valve insert member threadably received in said receptacle and including at its inner extremity a first chamber in communication with said first bore, said insert member defining with said valve body a second chamber in communication with said outlet port, said valve insert member including an elongated second bore, a pressure control passage extending between said first chamber and said second bore, and a flow control orifice extending between said second chamber and said second bore, the inner end wall of said second bore mounting a valve seat surrounding the adjacent terminus of said pressure control passage;

(c) a valve closure member having a piston axially slidable in said second bore and defining with said valve insert member a third chamber in communication with said pressure control passage and said flow control orifice, said piston mounting resilient seal means confronting said valve seat;

(d) first bias means biasing said valve closure member to urge said resilient seal means against said valve seat to seal said pressure control passage;

(e) a ball valve in said first chamber;

(f) second bias means tending to urge said ball valve against the adjacent terminus of said pressure control passage to substantially but not completely block the flow of breathing gas through said pressure control passage; and (g) a pin axially slidable in said pressure control passage and engaged at one end by said ball valve and at the opposite end by said resilient seal means whereby, upon unseating of said resilient seal means from said valve seat, the axial position of said resilient seal means tends to control the pressure of breathing gas conveyed to said hood.

2. Breathing apparatus according to claim 1 wherein said supply bottle comprises a cylinder containing oxygen enriched air having an elemental oxygen content from about 26 to 32 volume percent and a sufficient volume to maintain an oxygen level in said hood at least about 16 volume percent for at least about 1.6 liters per minute.

3. Breathing apparatus according to claim 2 wherein said oxygen enriched air is contained in said cylinder at a maximum pressure of about 1800 psig.

4. Breathing apparatus according to claim 2 wherein said gas supply valve means regulates the flow of oxygen enriched air to said hood at a rate of about 10 liters per minute.

* * * * *